US006326343B1

(12) United States Patent
Ghatlia et al.

(10) Patent No.: US 6,326,343 B1
(45) Date of Patent: Dec. 4, 2001

(54) THREE-IN-ONE COMPOSITION FOR DISHWASHING MACHINES

(75) Inventors: Naresh Dhirajlal Ghatlia, Rutherford, NJ (US); Donna Wu, Nanuet, NY (US); Alla Tartakovsky, West Orange, NJ (US); Joseph Oreste Carnali, Pompton Plains, NJ (US); Yu-Min Catherine Chiou, Saddle Brook, NJ (US)

(73) Assignee: Unilever Home & Personal Care USA, Division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/657,749

(22) Filed: Sep. 8, 2000

(51) Int. Cl.[7] ..... C11D 3/06; C11D 3/26; C11D 3/37

(52) U.S. Cl. ..... 510/222; 510/180; 510/181; 510/220; 510/224; 510/228; 510/500; 510/504; 510/505; 134/25.2

(58) Field of Search ..... 510/181, 180, 510/220, 222, 224, 228, 500, 504, 505; 134/25.2

(56) References Cited

U.S. PATENT DOCUMENTS

| | | | | |
|---|---|---|---|---|
| 5,958,855 | * | 9/1999 | Binstock et al. | 510/224 |
| 5,981,456 | * | 11/1999 | Tartakovsky et al. | 510/220 |
| 5,989,322 | * | 11/1999 | Riggs, Jr. | 106/14.44 |
| 5,998,345 | * | 12/1999 | Gorlin et al. | 510/224 |
| 6,239,091 | * | 5/2001 | Tartakovsky et al. | 510/220 |

* cited by examiner

*Primary Examiner*—Gregory Delcotto
(74) *Attorney, Agent, or Firm*—Edward A. Squillante, Jr.

(57) ABSTRACT

A dishwashing composition with polymers having a positive charge and water soluble entities that reduce phosphate scale formation is described. The dishwashing composition displays excellent cleaning benefits and gloss appearance, even in the absence of NaCl additives and conventional rinse aid compositions.

11 Claims, No Drawings

THREE-IN-ONE COMPOSITION FOR DISHWASHING MACHINES

FIELD OF THE INVENTION

This invention is directed to a composition for use in a dishwashing machine. More particularly, the invention is directed to a superior dishwashing composition that has a polymer comprising a positive charge and a water soluble polymer that reduces phosphate scale formation. The dishwashing composition unexpectedly results in excellent cleaning properties and excellent glass appearance when used to clean glassware even in the presence of hard water and in the absence of conventional rinse aid compositions.

BACKGROUND OF THE INVENTION

Dishwashing compositions constitute a generally recognized distinct class of detergent compositions, particularly when compared to detergents designed for fabric washing. For example, the ultimate dishwashing composition results in a spotless and film-free appearance on glassware and silverware after a cleaning cycle in a dishwashing machine. In fabric washing operations, on the otherhand, detergent compositions which result in greasy, oily or soapy residues on items that were cleaned can be tolerated.

Often, washing articles in a commercially available dishwashing machine entails using three products. Salt is added to the salt compartment to recharge the ion exchanger which softens the water, a dishwashing formulation is used to clean the articles and a rinse aid is used to ensure that the articles are rinsed with no streaks or smears. Consumers generally find it very inconvenient, however, to replace or refill such products.

In order to provide convenient products to consumers, manufacturers have been making dishwashing tablets in order to eliminate detergent handling and dosing issues. Such tablets often have a detergent portion, and a wax portion which contains a rinse aid. These types of tablets, which are sometimes referred to as 2-in-1 tablets, have disadvantages since they may only be used in a wash cycle that does not exceed 55° C. This is true because the wax portion which contains the rinse aid will completely dissolve in a wash cycle that exceeds 55° C. This causes all of the rinse aid to drain out of the dishwashing machine before the actual rinse cycle. Furthermore, such 2-in-1 tablets require that salt be added to the dishwashing machine in order to obtain optimal results, and they are very complicated and expensive to produce.

Other types of tablets that are well known are often referred to as pH sensitive 2-in-1 tablets . These types of tablets have a detergent portion and rinse aid portion that is contained in a pH sensitive material. The pH sensitive 2-in-1 tablets may be used in wash cycles that exceed 55° C. However, like the detergent tablets with the wax portion, the pH sensitive 2-in-1 tablets require that salt be added to the dishwashing machine in order to obtain optimal cleaning results and they are extremely expensive to produce.

In view of the vast deficiencies of the conventional products, it is of increasing interest to provide a dishwashing composition, such as a dishwashing tablet, that works well at all wash temperatures of a dishwashing system (even temperatures greater than 55° C.), provides antiscaling benefits in a system that is high in phosphate content (in hard water), does result in excellent cleaning benefits in water that has not been subjected to conventional water softening additives (i.e., hard water) and provides a glossy glassware appearance in the absence of conventional rinse aid compositions. This invention, therefore, is directed to a dishwashing composition that has a polymer comprising a positive charge and a water soluble polymer that reduces phosphate scale formation on glassware being cleaned. The dishwashing composition is superior in that it unexpectedly results in excellent cleaning properties, and reduced spotting and scale formation even when no salt is added to the dishwashing machine to soften hard water, when washing cycles exceed a temperature of 55° C., and when no rinse aid composition is added to the dishwashing machine. In fact, the present invention is directed to a superior 3-in-1 detergent composition that is inexpensive to produce and very easy for the consumer to use.

BACKGROUND MATERIAL

Efforts have been made to prepare dishwashing compositions. In U.S. Pat. No. 5,939,373, an automatic dishwashing detergent composition comprising a phosphate builder and a metal containing bleach catalyst is described.

Still other efforts have been disclosed for making dishwashing compositions. In WO 00/06688, a dishwashing composition with a coated core is described. The coated core has a substance that exerts function in a clear rinse cycle.

Even further, other efforts have been disclosed for making dishwashing compositions. In DE 197 27 073 A1, coated detergent components are described.

None of the material above describes a dishwashing composition that has a polymer with a positive charge and a water soluble polymer that reduces phosphate scale formation wherein the dishwashing composition results in excellent cleaning properties and glass appearance when used, for example, in the presence of hard water, in the absence of rinse aid compositions and even in a washing cycle that exceeds a temperature of 55° C.

SUMMARY OF THE INVENTION

In a first aspect, the present invention is directed to a hard water dishwashing composition effective for cleaning and reducing spotting and phosphate scale formation on glassware, the dishwashing composition comprising:

a) a polymer having a weight average molecular weight of greater than about 2,000 and comprising a positive charge; and b) a water soluble polymer that reduces phosphate scale formation.

In a second aspect, this invention is directed to a method for minimizing spotting and phosphate scale formation on glassware being cleaned, comprising the steps of:

a) subjecting the glassware to a dishwashing composition comprising a polymer comprising a positive charge, and a water soluble polymer that reduces phosphate scale formation;

b) subjecting the glassware to hard water; and c) removing the glassware from the hard water wherein the glassware is not subjected to a rinse aid composition.

In a third aspect, this invention is directed to a package comprising the dishwashing composition described in the first aspect of this invention and instructions not to use a rinse aid composition or conventional water softening salts or both.

As used herein, glassware is defined to include drinking glasses and any other articles typically found in a commercial or domestic dishwasher.

DETAILED DESCRIPTION OF THE PREFERRED EMBODIMENTS

As used in this invention, a polymer comprising a positive charge is defined to mean an entity prepared from at least two monomeric units whereby at least one monomeric unit comprises a positive charge. There generally is no limitation with respect to the type of polymer comprising a positive charge that may be used in this invention other than that the positively charged polymer can be used in a dishwashing composition that comprises a water soluble polymer that reduces phosphate scale formation. Such a polymer comprising a positive charge often has a weight average molecular weight of greater than about 2,000; and preferably, greater than about 3,000; and most preferably, greater than about 4,000.

The polymer comprising a positive charge which may be used in this invention is typically soluble or dispersible to at least the extent of 0.01% by weight in distilled water at 25° C. Such a positively charged polymer includes polymers in which one or more of the constituent monomers maintains a positive charge in solution over a portion of the pH range 2–11. A partial listing of the monomers which may be used to make the polymers in this invention are presented in "Water-Soluble Synthetic Polymers: Properties and Behavior, Volume II", by P. Molyneux, CRC Press, Boca Raton, 1983, ISBN 0-8493-6136, the disclosure of which is incorporated herein by reference. Additional monomers can be found in the "International Cosmetic Ingredient Dictionary, 5th Edition", edited by J. A. Wenninger and G. N. McEwen, The Cosmetic, Toiletry, and Fragrance Association, Washington DC, 1993, ISBN 1-882621-06-9, the disclosure of which is incorporated herein by reference. A third source of such monomers can be found in "Encyclopedia of Polymers and Thickeners for Cosmetics", by R. Y. Lochhead and W. R. Fron, Cosmetics & Toiletries, vol. 108, May 1993, pages 95–135, the disclosure of which is also incorporated herein by reference.

Often, preferred monomers useful to make the polymers comprising a positive charge in this invention may be represented structurally as ethylenically unsaturated compounds having the formula:

(I)

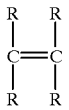

wherein each R is independently a hydrogen, derivatized hydroxy, $C_1$ to $C_{30}$ straight or branched alkyl group, aryl, aryl substituted $C_{1-30}$ straight or branched alkyl radical, or a polyoxyalkene condensate of an aliphatic moiety, a heteroatomic organic group comprising at least one positively charged group without a charged nitrogen, quaternized nitrogen atom or at least one amine group comprising a positive charge over a portion of the pH interval 2 to 11, with the proviso that at least one R group is a heteratomic organic group that has a positive charge without a charged nitrogen, a quaternized nitrogen atom group or an amine group comprising a positive charge. Such amine groups can be further delineated as having a $pK_a$ of about 6 or greater, as defined by R. Laughlin in "Cationic Surfactants, Physical Chemistry", edited by D. N. Rubingh and P. M. Holland, Marcel Dekker, New York, 1991, ISBN 0-8247-8357-3. Moreover, it is further noted herein that salts of the monomers represented by formula I may also be used to make the polymers comprising the positive charge in this invention.

Examples of monomers comprising a positive charge as depicted by formula I include, but are not limited to, 2-vinylpyridine and its 2-vinyl N-alkyl quaternary pyridinium salt derivatives; 4-vinylpyridine and its 4-vinyl N-alkyl quaternary pyridinium salt derivatives; 4-vinylbenzyltrialkylammonium salts such as 4-vinylbenzyltrimethylammonium salt; 2-vinylpiperidine and 2-vinyl piperidinium salt; 4-vinylpiperidine and 4-vinylpiperidinium salt; 3-alkyl 1-vinyl imidazolinium salts such as 3-methyl 1-vinylimidazolinium salt; acrylamido and methacrylamido derivatives such as dimethyl aminopropylmethacrylamide, and methacrylamidopropyl trimethylammonium salt; acrylote and methacrylate derivatives such as dimethyl aminoethyl (meth)acrylate, ethanaminium N,N,N trimethyl 2-[(1-oxo-2 propenyl) oxy]-salt, ethanaminium N,N,N trimethyl 2-[(2 methyl-1-oxo-2 propenyl) oxy]-salt, and ethanaminium N,N,N ethyl dimethyl 2-[(2 methyl-1-oxo-2 propenyl) oxy]-salt. Also included among the monomers suitable to make the polymers with a positive charge employable in this invention are vinyl amine and vinylammonium salt; diallylamine, and methyidiallylamine.

Also, if desired, monomers containing cationic sulfonium salts such as 1-[3-methyl-4-(vinyl-benzyloxy)phenyl] tetrahydrothiophenium chloride may also be used to make the polymers comprising the positive charge of this invention.

Illustrative polymers comprising a positive charge which may be used in this invention include those having a backbone comprising the structural unit:

(II)

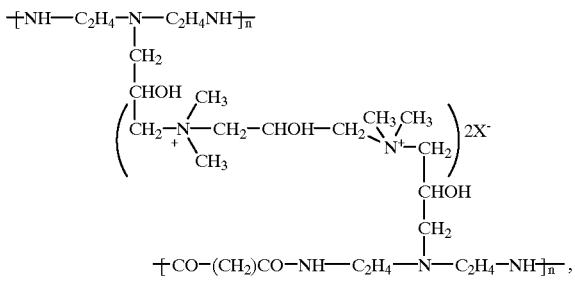

and those having a backbone comprising the structural unit:

(III)

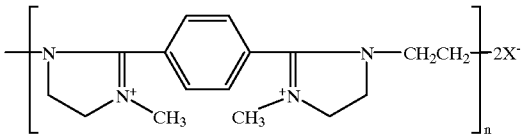

wherein each n is independently 1 to 100,000 and X is chosen from the halides: chloride, bromide, and iodide; or from hydroxide, phosphate, sulfate, hydrosulfate, ethyl sulfate, methyl sulfate, mesylate, tosylate, formate, and acetate.

Other positively charged polymers (not the polymerization product of the monomers represented by formula 1) suitable for use in this invention are those arising from natural sources and include cocodimethylammonium hydroxypropyl oxyethyl cellulose, louryldimethylammonium hydroxypropyl oxyethyl cellulose, stearyldimethylammonium hydroxypropyl oxyethyl cellulose, and stearyldimethylammonium hydroxyethyl cellulose; guar 2-hydroxy-3-(trimethylammonium) propyl ether salt; cellulose 2-hydroxyethyl 2-hydroxy 3-(trimethyl ammonio) propyl ether salt.

Still other polymers (not the polymerization product of the monomers represented by formula 1) having a positive charge which may be used in this invention include the ionene class of internal positively charged polymers. These polymers are defined by D. R. Berger in "Cationic Surfactants, Organic Chemistry", edited by J. M. Richmond, Marcel Dekker, New York, 1990, ISBN 0-8247-8381-6, herein incorporated by reference. This class of ionene polymers includes co-poly ethylene imine, co-poly ethoxylated ethylene imine and co-poly quaternized ethoxylated ethylene imine; co-poly [(dimethylimino) trimethylene (dimethylimino) hexamethylene disalt]; co-poly [(diethylimino) trimethylene (dimethylimino) trimethylene disalt]; co-poly [(dimethylimino) 2-hydroxypropyl salt]; co-polyquaternium-2, co-polyquaternium-17, and co-polyquaternium 18, as defined in the "International Cosmetic Ingredient Dictionary, 5th Edition", edited by J. A. Wenninger and G. N. McEwen.

Even other positively charged polymers suitable for use in the present invention include polymers in which one or more of the constituent monomers (precursor monomers) contain at least one positive charge and at least one negative charge over a portion of the pH range 2–11. Such monomers include those comprising formal anionic and cationic charges such as N,N-dimethyl N-acetyl aminoethylmethacrylate. Also included are those polymers derived from monomers which, while not possessing formal charges, have one or more resonance forms which result in the occurrence of fractional positive and negative charges being separated within the monomer. Such monomers are typified by vinyl pyrrolidone, as described in "Water-Soluble Synthetic Polymers: Properties and Behavior, Volume 1", by P. Molyneux, CRC Press, Boca Raton, 1983, ISBN 0-8493-6135-4, the disclosure of which is incorporated herein by reference.

The preferred polymers comprising a positive charge that may be used in this invention are derived from the polymerization of diallyidimethylammonium salts, having the chemical structure as unpolymerized or polymerized monomer, respectively, of formula IVa or IVb:
wherein n and X are as previously defined.

(IVa)

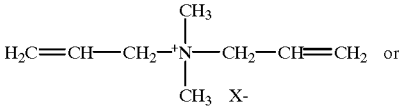

(IVb)

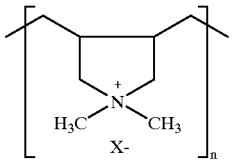

Still other preferred polymers comprising a positive charge employable in this invention include those polymerized from acrylamidopropyl trimethylammonium salt. Examples of the former preferred polymers are made commercially available by Nalco under the name Merquat Plus 3331. Examples of the latter polymers are developed by Rohm & Haas under the name PC2.

There is no limitation with respect to the amount of polymer with a positive charge that may be used in this invention other than that the amount used results in a dishwashing composition. Typically, however, from about 0.1 to about 10.0, and preferably, from about 0.2 to about 7.0, and most preferably, from about 0.3 to about 5.0% by wt. of the dishwashing composition is a polymer comprising a positive charge, based on total weight of the dishwashing composition, including all ranges subsumed therein.

In general, the polymers comprising the positive charge which may be used in this invention are typically made commercially available from suppliers like Nalco and Rohm & Haas. The monomers used to make the polymers having a positive charge may be provided by suppliers like Aldrich and Sigma. Such polymers may also be prepared via conventional reactions which include free radical polymerizations.

As to the water soluble polymer that reduces phosphate scale formation, such a polymer often comprises at least one structural unit derived from a monomer having the formula:

(V)

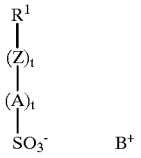

wherein $R^1$ is a group comprising at least one $sp^2$ bond, Z is O, N, P, S, or an amido or ester link, A is a mono- or a polycyclic aromatic group or an aliphatic group and each t is independently 0 or 1 and $B^+$ is a monovalent cation.

Preferably, $R^1$ is a $C_2$ to $C_6$ alkene (most preferably ethene or propene). When $R^1$ is ethenyl, Z is preferably amido, A is preferably a divalent butyl group, each t is 1, and $B^+$ is $Na^+$. Such a monomer is polymerized and sold as Acumer 3100 by Rohm & Haas.

Another preferred embodiment exists when the water soluble polymer is derived from at least one monomer with $R^1$ as 2-methyl-2-propenyl, Z as oxygen, A as phenylene, each t as 1 and $B^+$ as $Na^+$, and at least one monomer with $R^1$ as 2-methyl-2-propenyl, each t as 0 and $B^+$ as $Na^+$. Such monomers are polymerized and sold under the name Alcosperse 240 by Alco Chemical.

It is further noted herein that it is within the scope of this invention for all the polymers used to be a homopolymer or copolymer, including terpolymers. Furthermore, the polymers of this invention may be terminated with conventional termination groups resulting from precursor monomers and/or initiators that are used.

There is generally no limitation with respect to how much water soluble polymer that reduces phosphate scale formation is used in this invention as long as the amount used results in a dishwashing composition. Often, from about 0.5 to about 10.0, and preferably, from about 1.0 to 7.0, and most preferably, from about 1.5 to about 4.5% by weight water soluble polymer is used, based on total weight of the dishwashing composition, including all ranges subsumed therein. These water soluble polymers typically have a weight average molecular weight from about 1,000 to about 50,000.

Phosphate containing builders are a preferred additive in this invention. Such builders typically make up from about 5.0 to about 75.0% by weight of the total weight of the dishwashing composition, including all ranges subsumed therein. Preferably, however, the amount of phosphate containing builder employed is from about 10.0 to about 70.0, and most preferably, from about 15.0 to about 65.0% by weight based on total weight of the dishwashing composition and including all ranges subsumed therein. The phosphate containing builders which may be used in this invention are well known, for example, for binding metals such as Ca and Mg ions, both of which are often abundant in hard water found in dishwashing machines. An illustrative list of the phosphate builders which may be used in this invention include sodium, potassium and ammonium pyrophosphate; alkali metal tripolyphosphates, sodium and potassium orthophosphate and sodium polymetaphosphate, with sodium tripolyphosphate being especially preferred.

Other additives which may be used in this invention include well known items such as perfumes, antifoaming agents, anti-tarnish agents, disintegrants, and processing aids (e.g., polyethylene glycol) which aid in forming tablet-type dishwashing compositions. Such additives, collectively, do not normally make up more than about 8.0% by weight of the total weight of the dishwashing composition.

It is also within the scope of this invention to use conventional dishwashing bleaches and activators (e.g., from about 0.02 wt. % to about 20.0 wt. % based on total weight of the dishwashing composition). Such bleaches include inorganic and organic peracids as well as salts thereof. Examples include epsilon phthalimido perhexanoic acid and Oxone®, respectively.

Other bleaches which may be used in this invention include hydrogen peroxide and its precursors (e.g., sodium perborate and sodium percarbonate).

If desired, conventional bleach activators (including catalysts) may be used with the bleaches described herein. These activators include N,N,N',N'-tetraacetylethylenediamine, nonanoyloxybenzenesulfonate cationic nitriles, cholyl(4-sulfophenyl)carbonate, and quaternary imine salts (e.g., N-methyl-3,4-dihydrooisoquinolinium p-toluenesulfonate).

Other bleach activators which may be used include transition metal-containing bleach catalysts such as $[Mn^{IV}{}_2(\mu\text{-}0)_3(Me_3TACN)_2](PF_6)_2$ (as described in U.S. Pat. Nos. 4,728,455, 5,114,606, 5,153,161, 5,194,416, 5,227,084, 5,244,594, 5,246,612, 5,246,621, 5,256,779, 5,274,147, 5,280,117), $[Fe^{II}(MeN4py)(MeCN)](ClO_4)_2$ (as described in EP 0 909 809) and $[Co^{III}(NH_3)_5(OAc)](OAc)_2$ (as described in U.S. Pat. No. 5,559,261, WO 96/23859, WO 96/23860, WO 96/23861), the disclosures of which are incorporated herein by reference.

It is also within the scope of this invention to employ conventional dishwashing enzymes and buffers. The former typically make up from about 0.5 to about 10.0% by weight of the total weight of the dishwashing composition and include proteases like Savinase®), Purafect Ox® and Properase® and amylases like Termamyl®, Purastar ST® and Purastar Ox Am®, all of which are commercially available. The latter typically make up from about 5.0 to about 25.0% by weight of the total weight of the dishwashing composition and include well known buffers like sodium disilicate, sodium metasilicate and sodium carbonate.

When washing glassware with the dishwashing composition of this invention, soiled glassware is typically placed in a conventional domestic or commercial dishwashing machine as is the dishwashing composition of this invention (in no particular order). The dishwashing composition, in the form of a liquid, powder or detergent tablet, preferably a tablet, then dissolves in the water of the dishwasher to wash the glassware. The typical dishwashing cycle is from about 10 minutes until about 60 minutes and the typical temperature of the water in the dishwasher is from about 40° C. to about 70° C. The glassware resulting from the above-described cleaning method is clean and has an excellent glass appearance (i.e., substantially free of film and spots). Such results are unexpectedly obtained even when hard water at high temperatures (greater than 55° C.) is used, in the absence of rinse aid compositions.

When marketing the superior dishwashing composition of this invention, it is preferred that the dishwashing composition is formed into a tablet and sold in a package with directions to add the dishwashing composition to the dishwashing machine as a 3-in-1 product. Thus, a dishwasher is charged with the dishwashing composition of this invention without having to add to the dishwasher conventional rinse aid compositions and sodium chloride.

The Examples below are provided to further illustrate an understanding of the present invention, and they are not intended to limit the scope of the invention as set forth in the claims.

TABLE 1

Abbreviations Summary

| | |
|---|---|
| AA | Polyacrylic acid |
| AM | Acrylamide |
| AMPS | 2-Acrylamido-2-methylpropane sulfonic acid |
| APTAC | (3-Acrylamidopropyl) trimethylammonium chloride |
| DMDAAC | Dimethyl diallyl ammonium chloride |
| HEDP | 1-hydroxyethylene-1,1-diphosphonic acid |
| MMA | Methyl methacrylate |
| SMS | 2-Methyl-2-propene-1-sulfonic acid, sodium salt |
| SPME | 4-[(2-Methyl-2-propenyl)oxy]benzenesulfonic acid, sodium salt |

TABLE 2

Base Formulation used in Examples 1 and 2

| Ingredients | % wt |
|---|---|
| Sodium tripolyphosphate | 64.1 |
| Sodium disilicate | 20.5 |
| Sodium perborate monohydrate | 9.5 |
| Tetraacetyl ethylene diamine-83% | 2.5 |
| Enzymes | 3.3[1] |
| 1,2,3-Benzotriazole | 0.05 |

[1]Protease + Amylase made commercially available by Novo

EXAMPLE 1

All dishwashing machine tests were carried out using a Miele G656 dishwasher setting at the 55° C. Normal program, which consisted of a main wash (heated to 55° C.), followed by a cold rinse and a heated (to 65° C.) final rinse with a non-heated dry cycle. Water hardness was adjusted to contain 300 ppm of total hardness ($Ca^{2+}$:$Mg^{2+}$=4:1, expressed as $CaCO_3$) and 320 ppm of temporary hardness expressed as sodium carbonate (i.e. 300/320 ppm water hardness). A typical dishware set for machine dishwasher tests included 8 clean drinking glasses (on the upper rack), 2 plastic containers, 6 tea cups, 1 melamine plate, 1 Teflon-coated frying pan and 16 clean plates to mimic the actual washing conditions.

When a three-run build-up test was ready to be started, 18 g of base formulation (Table 2) was added in the dispenser cup of the dishwasher. In addition, 0.27 g of cationic polymer (Merquat Plus 3331) and 0.54 g of antiscalant (Table 3) were dosed via the dispenser cup or added directly into the machine at the dispenser cup opening at the beginning of the main wash. Forty grams of ASTM standard food soil, described in Section 5.2 of ASTM Method D 3556-85, "Standard Test Method for Deposition on Glassware During mechanical Dishwashing" was spread on the dishwasher door prior to the beginning of each run. This soil consists of 80% margarine and 20% low fat powdered milk.

The same dishware set was put through three consecutive cycles with the same detergent formulation and soil load. At the end of each machine run, drinking glasses were removed and graded inside a viewing cabinet according to extent of spotting and filming. Both spotting and filming scores were recorded based on area covered by and intensity of spots and film, respectively. Spotting scores are expressed on a 0 to 4 scale and filming scores are recorded on a 0 to 5 scale, 0 being completely free of spots or film. The sum of spotting and filming score indicates the overall glass appearance, i.e. the higher the total score meaning a poorer final glass appearance. Results are recorded in Table 3.

TABLE 3

Effect of antiscalant on glass appearance* in three-run build-up tests

| Test No. | Cationic Polymer | Antiscalant | Final Run Spot | Final Run Film | Total* Score |
|---|---|---|---|---|---|
| 1 | AA/DMDAAC/AM[1] | None (control) | 2.3 | 1.2 | 3.5 |
| 2 (Invention) | AA/DMDAAC/AM[1] | AA/MMA/SPME/SMS[2] | 0.1 | 1.2 | 1.3 |
| 3 (Invention) | AA/DMDAAC/AM[1] | AA/AMPS[3] | 0.1 | 1.3 | 1.4 |
| 4 (Comparative) | AA/DMDAAC/AM[1] | Mixture of acrylate homopolymer[4] and acrylate/maleate copolymer[5] (1:2 w/w) | 3.3 | 0.7 | 4.0 |
| 5 (Comparative) | AA/DMDAAC/AM[1] | Mixture of acrylate homopolymer[4] and HEDP[6] (3:1 w/w) | 0.5 | 2.8 | 3.3 |

*Glass appearance is judged by residual film and spots, i.e. higher the total score of spot and film indicating poorer overall glass appearance.
**Visual observations
[1]Merquat Plus 3331 (INCI: Polyquaternium-39) supplied by Nalco Chemical.
[2]Alcosperse 240 supplied by Alco Chemical (water soluble polymer that reduces phosphate scale).
[3]Acumer 3100 supplied by Rohm and Haas (water soluble polymer that reduces phosphate scale).
[4]Sokalan PA25 supplied by BASF.
[5]Sokalan CP5 supplied by BASF.
[6]Dequest 2016 supplied by Solutia Chemical.

As shown in Table 3, phosphate antiscaling polymers greatly enhance glass appearance in the presence of a cationic polymer under hard water washing conditions (Tests No. 2 and 3). Conventional dispersing polymers, such as polycarboxylate polymers, in fact, cause an increase of spots on glassware; as such, giving worsened glass appearance (Test No. 4). Inclusion of a phosphonate de-scaling sequestrant (e.g. HEDP) does not provide any benefit on enhancing overall glass appearance (Test No. 5).

EXAMPLE 2

Experiments were carried out in a Zanussi DWS 677 dishwasher, Economy 55° C. program. Water used for the runs was adjusted to 300 ppm permanent hardness with Ca:Mg=4:1 and 320 ppm of temporary hardness expressed as $NaCO_3$.

Each experiment consisted of 3 consecutive machine runs where glass appearance data reported in the example is the result of the last run.

Soils used in each run included:

3 ceramic plates coated with 2.0 g egg yolk on each plate; 3 stainless steel plates coated with 2.0 g each of egg yolk; 3 ceramic plates coated with 2.0 g ea. of potato starch soil; 3 ceramic plates coated with 2.0 g ea. of cream of wheat; 40 g of ASTM butter-milk soil; 3 cups with 3× tea stain; 4 glasses with lipstick impression.

5 clean glasses were placed onto the top rack of dishwasher and were kept there for all runs while above described soiled articles were replaced for each run.

TABLE 4

Effect of cationic polymer and antiscalant on glass appearance* in three-run build-up tests

| Test No. | Cationic Polymer | Antiscalant | Final Run Spot | Final Run Film | Total* Score |
|---|---|---|---|---|---|
| 1 | None (control) | None (control) | 4 | 1 | 5 |
| 2 | AA/APTAC[1] | None (control) | 1 | 1.5 | 2.5 |
| 3 (Invention) | AA/APTAC[1] | AA/AMPS[2] | 0 | 0.6 | 0.6 |
| 4 (Comparative) | AA/APTAC[1] | Mixture of acrylate homopolymer[3] and acrylate/maleate copolymer[4] (1:2 w/w) | 0.4 | 2 | 2.4 |
| 5 (Comparative) | AA/APTAC[1] | Mixture of acrylate homopolymer[3] and HEDP[5] (3:1 w/w) | 0 | 1.75 | 1.75 |

*Glass appearance is judged by residual film and spots, i.e. higher the total score of spot and film indicating poorer overall glass appearance.
**Visual observations
[1]PC2 supplied by Rohm and Haas.
[2]Acumer 3100 supplied by Rohm and Haas.
[3]Sokalan PA25 supplied by BASF.
[4]Sokalan CP5 supplied by BASF.
[5]Dequest 2016 supplied by Solutia Chemical.

As shown in Table 4, phosphate antiscaling polymers greatly enhance glass appearance in the presence of a cationic polymer under hard water washing conditions (Test No. 3). Conventional dispersing polymers, such as polycarboxylate polymers, giving worsened glass appearance (Test No. 4). Inclusion of a phosphonate based de-scaling sequestrant (e.g. HEDP) also leads to worse glass appearance by causing an increase in the film score (Test No. 5), relative to the invention (Test No. 3).

What is claimed is:

1. A dishwashing composition effective for cleaning glassware in hard water, the dishwashing composition comprising:

(a) from about 0.1 to about 10% by weight of the dishwashing composition of a polymer having a weight average molecular weight of greater than about 2,000, comprising a positive charge and derived from at least one monomer selected from the group consisting of diallyldimethylammonium salt or acrylamidopropyl trimethylammonium salt; and (b) from 0.5 to 10% by weight of the dishwashing composition of a water soluble polymer that reduces phosphate scale formation wherein the water-soluble polymer that reduces phosphate scale formation has a polymer backbone comprising at least one structural unit derived from a monomer having the formula:

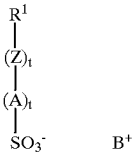

wherein $R^1$ is a group comprising at least one $sp^2$ bond, Z is O, N, P, S, or an amido or ester link, A is a mono- or a polycyclic aromatic group or an aliphatic group and each t is independently 0 or 1 and B+ is a monovalent cation.

2. The dishwashing composition according to claim 1 wherein the dishwashing composition does not comprise a rinse aid composition.

3. The dishwashing composition according to claim 1 wherein the dishwashing composition does not require sodium chloride for recharging an ion exchanger.

4. The dishwashing composition according to claim 1 wherein $R^1$ is ethenyl, Z is amido, A is a divalent butyl group, each t is 1 and $B^+$ is $Na^+$.

5. The dishwashing composition according to claim 1 wherein the polymer backbone has at least one structural unit derived from the monomer wherein $R^1$ is 2-methyl-2-propenyl, Z is oxygen, A is phenylene, each t is 1 and $B^+$ is $Na^+$, and at least one structural unit derived from the monomer where $R^1$ is 2-methyl-2-propenyl, each t is 0, and $B^+$ is $Na^+$.

6. The dishwashing composition according to claim 1 wherein the composition further comprises from about 5.0% to about 75.0% of a phosphate builder.

7. A method for minimizing spotting and phosphate scale formation on glassware being cleaned, comprising the steps of:

(a) charging a dishwashing machine with soiled glassware and a dishwashing composition comprising:

(i) from about 0.1 to about 10% by weight of the dishwashing composition of a polymer having a weight average molecular weight of greater than about 2000, comprising a positive charge, and derived from at least one monomer selected from the group consisting of diallyldimethylammonium salt or acrylamidopropyl trimethylammonium salt; and (ii) from 0.5 to 10% by weight of the dishwashing composition of a water soluble polymer that reduces phosphate scale formation wherein the water-soluble polymer that reduces phosphate scale formation has a polymer backbone comprising at least one structural unit derived from a monomr having the formula:

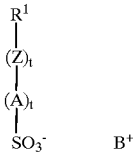

wherein $R^1$ is a group comprising at least one $sp^2$ bond, Z is O, N, P, S, or an amido or ester link, A is a mono- or a polycyclic aromatic group or an aliphatic group and each t is independently 0 or 1 and B+ is a monovalent cation;

(b) running a dishwashing cleaning cycle; and (c) removing clean glassware.

8. The method according to claim 7 wherein a rinse aid composition is not added to the dishwashing composition or the dishwashing machine.

9. The method according to claim 7 wherein an ion exchange salt is not added to the dishwashing machine.

10. A package for a dishwasher comprising a composition comprising:

(a) from about 0.1 to about 10% by weight of the dishwashing composition of a polymer having a weight average molecular weight of greater than about 2,000, comprising a positive charge, and derived from at least one monomer selected from the group consisting of diallyldimethylammonium salt or acrylamidopropyl trimethylammonium salt;

(b) from 0.5 to 10% by weight of the dishwashing composition of a water soluble polymer that reduces phosphate scale formation wherein the water-soluble polymer that reduces phosphate scale formation has a polymer backbone comprising at least one structural unit derived from a monomr having the formula:

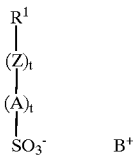

wherein $R^1$ is a group comprising at least one $sp^2$ bond, Z is O, N, P, S, or an amido or ester link, A is a mono- or a polycyclic aromatic group or an aliphatic group and each t is independently 0 or 1 and B+ is a monovalent cation (c) instructions which direct a user to utilize the composition in the dishwasher without adding an ion exchange salt or a rinse aid composition, or both.

11. A package according to claim 10 wherein the package indicates that the composition is a 3-in-1 composition, or a 3-in-1 detergent, or a 3-in-1 dishwashing composition.

* * * * *